US008065957B2

(12) United States Patent
Schaede et al.

(10) Patent No.: US 8,065,957 B2
(45) Date of Patent: Nov. 29, 2011

(54) INSPECTION SYSTEM FOR A SHEET-FED RECTO-VERSO PRINTING PRESS

(75) Inventors: Johannes Georg Schaede, Wurzburg (DE); Volker Lohweg, Bielefeld (DE); Bernd Stöber, Rheda-wiedenbrück (DE); Volkmar Schwitzky, Würzburg (DE); Günther Hoier, Veitshöchheim (DE)

(73) Assignee: KBA-NotaSys SA, Lausanne (CH)

( * ) Notice: Subject to any disclaimer, the term of this patent is extended or adjusted under 35 U.S.C. 154(b) by 608 days.

(21) Appl. No.: 12/281,248

(22) PCT Filed: Mar. 8, 2007

(86) PCT No.: PCT/IB2007/000562

§ 371 (c)(1),
(2), (4) Date: Aug. 29, 2008

(87) PCT Pub. No.: WO2007/105059

PCT Pub. Date: Sep. 20, 2007

(65) Prior Publication Data

US 2009/0025594 A1 Jan. 29, 2009

(30) Foreign Application Priority Data

Mar. 14, 2006 (EP) ..... 06005169

(51) Int. Cl.
*B41F 13/24* (2006.01)

(52) U.S. Cl. ..... 101/232; 101/242

(58) Field of Classification Search ..... 101/232
See application file for complete search history.

(56) References Cited

U.S. PATENT DOCUMENTS

| | | | | |
|---|---|---|---|---|
| 4,836,104 | A * | 6/1989 | Duarte | 101/420 |
| 5,329,852 | A | 7/1994 | Bolza-Schuenemann et al. | |
| 5,471,309 | A | 11/1995 | Bolza-Schunemann | |
| 5,724,437 | A * | 3/1998 | Bucher et al. | 382/112 |
| 6,101,939 | A | 8/2000 | Giori et al. | |
| 6,269,743 | B1 | 8/2001 | DeMoore et al. | |
| 6,822,590 | B2 * | 11/2004 | Kusaka | 341/104 |
| 6,883,429 | B2 * | 4/2005 | Kamoda | 101/480 |
| 7,000,540 | B2 * | 2/2006 | Conzelmann et al. | 101/230 |

(Continued)

FOREIGN PATENT DOCUMENTS

| | | |
|---|---|---|
| CH | 502 897 | 2/1971 |
| EP | 0 527 453 A1 | 2/1993 |
| EP | 0 576 824 A1 | 1/1994 |

(Continued)

*Primary Examiner* — Anthony Nguyen
(74) *Attorney, Agent, or Firm* — Seager, Tufte & Wickhem, LLC

(57) ABSTRACT

There is described a sheet inspection system for a sheet-fed recto-verso printing press of the type comprising two printing cylinders (10, 20) for carrying out simultaneous recto-verso printing of the sheets, said sheet inspection system comprising at least one inspection device (200; 300; 400) for taking an image of one side of the printed sheets. The sheet inspection system comprises first and second transfer cylinders (60, 65) interposed between a first (10) of the two printing cylinders (10, 20) and a chain gripper system (5) of the printing press, printed sheets being transferred successively from the first printing cylinder (10) to the first transfer cylinder (60), to the second transfer cylinder (65), and to the chain gripper system (5). The inspection device (200; 300; 400) comprises a line image sensor (210; 310; 410) for performing line-scanning image acquisition of the one side of the printed sheets, this line image sensor (210; 310; 410) visually acquiring an image of a printed sheet while the printed sheet is being transported on the first or second transfer cylinder (60; 65).

14 Claims, 3 Drawing Sheets

U.S. PATENT DOCUMENTS

| | | | | |
|---|---|---|---|---|
| 7,096,784 | B2 * | 8/2006 | Giori et al. | 101/232 |
| 7,131,376 | B2 * | 11/2006 | Yamamoto et al. | 101/350.1 |
| 2001/0054364 | A1 * | 12/2001 | Kusaka | 101/483 |
| 2004/0026851 | A1 * | 2/2004 | Schaede et al. | 271/277 |
| 2004/0173113 | A1 | 9/2004 | Dunninger et al. | |
| 2004/0255802 | A1 * | 12/2004 | Conzelmann et al. | 101/230 |
| 2005/0249380 | A1 | 11/2005 | Geissler et al. | |
| 2006/0213384 | A1 * | 9/2006 | Reinhard et al. | 101/216 |

FOREIGN PATENT DOCUMENTS

| | | | |
|---|---|---|---|
| EP | 0 949 069 | A1 | 10/1999 |
| EP | 1 088 654 | A1 | 4/2001 |
| EP | 1 142 712 | A1 | 10/2001 |
| EP | 1 167 034 | A2 | 1/2002 |
| EP | 1 323 529 | A1 | 7/2003 |
| GB | 17138 | | 5/1973 |
| WO | 2005/115759 | A1 | 12/2005 |

* cited by examiner

INSPECTION SYSTEM FOR A SHEET-FED RECTO-VERSO PRINTING PRESS

TECHNICAL FIELD

The present invention generally relates to an inspection system for a sheet-fed recto-verso printing press. The present invention more particularly relates to such an inspection system for a sheet-fed recto-verso offset printing press.

BACKGROUND OF THE INVENTION

Sheet-fed recto-verso printing presses are known in the art, in particular for performing simultaneous recto-verso printing of sheets or webs.

Swiss patent CH 502 897 discloses a multi-color recto-verso printing press for performing simultaneous recto-verso offset printing. The press comprises two blanket cylinders contacting one another to form a printing nip where the paper is printed, each blanket cylinder carrying inked patterns to be applied on to the paper. The inked patterns are formed on the surface of the blanket cylinders by means of two groups of inking devices and plate cylinders. Sheets to be printed are fed to the printing location, between the two blanket cylinders, and are transferred, once printed, to a sheet delivery system, typically a so-called chain gripper systems comprising a plurality of spaced-apart gripper bars comprising a series of grippers for holding a leading edge of the sheets. Another example of a similar printing presses can be found in European patent application EP 0 949 069 A1.

For the purpose of ensuring a sufficient level of printing quality, it is often desired to carry out inspection of the freshly printed sheets on the printing press itself. One typically speaks in this case of in-line inspection, in contrast to off-line inspection where sheets are inspected separately from the printing press or presses where they were printed. In-line inspection system are for instance described in European patent applications EP 0 527 453 and EP 0 576 824. EP 0 576 824 in particular describes an in-line inspection system for carrying out inspection on a recto-verso printing press. In this example, inspection is carried out in the sheet transfer path between the printing station and a sheet-delivery station of the printing press.

Carrying out in-line inspection on recto-verso printing presses is rather complicated because both sides of the printed sheets are printed with fresh ink. Indeed, for inspection to be carried out, one must ensure that, during inspection, the printed sheet to be inspected or at least part of it is appropriately positioned with respect to a reference location. With single-sided printing press, the side of the sheet which has not been printed with fresh ink can be drawn against a reference surface, typically by means of suctions means, inspection of the other side of the sheet being carried out while the sheet is held against the reference surface. Such solution is described in the above-mentioned European patent application EP 0 527 453. With double-sided printing presses, such a solution can only be envisaged if the side of the sheet that is drawn against the reference surface has previously been dried. Otherwise, the contact of the freshly printed side of the sheet with the reference surface would cause smearing and therefore irremediably degrade the printing quality of that side of the sheet.

The solutions proposed so far for carrying out in-line inspection on recto-verso printing presses typically consist in locating the inspection system in the sheet-delivery path of the printing press, as proposed in European patent application EP 0 576 824. Further examples of such a principle can be found in European patent applications EP 1 142 712, EP 1 167 034 and EP 1 323 529. A problem with such solutions however resides in the increased complexity of the printing press. This is particularly the case of the solutions described in EP 1 142 712, EP 1 167 034 and EP 1 323 529 which require two separate sheet transport systems, namely a first one to transfer the sheets from the printing station to the sheet inspection system and a second one to transfer the sheets from the inspection system to the sheet-delivery station.

Still another problem of the prior art solutions, resides in the increased length of the sheet delivery path caused by the presence of the sheet inspection system itself, which thereby increases the footprint of the printing press as a whole.

There is therefore a need for a less complicated and more compact solution.

SUMMARY OF THE INVENTION

An aim of the invention is thus to improve the known sheet inspection system for recto-verso printing presses.

More particularly, an aim of the present invention is to provide a solution which does not substantially increase the complexity of the printing press and which can moreover be implemented in existing printing presses without major modifications.

Another aim of the present invention is to provide a solution which does not necessitate an increase of the length of the sheet transport path between the printing station and the sheet-delivery station.

Still another aim of the present invention is to provide a solution which can efficiently prevent smearing of the sheets during inspection.

These aims are achieved thanks to the inspection system and printing press defined in the claims.

According to the invention, a more compact solution is provided which does not require any increase of the footprint of the printing press as compared to a press without inspection. In addition, inspection is carried out at a location immediately following the printing operation. Smearing problems are thus reduced to a minimum.

Advantageous embodiments of the invention are the subject-matter of the dependent claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

EMBODIMENTS OF THE INVENTION

Figure 1A:
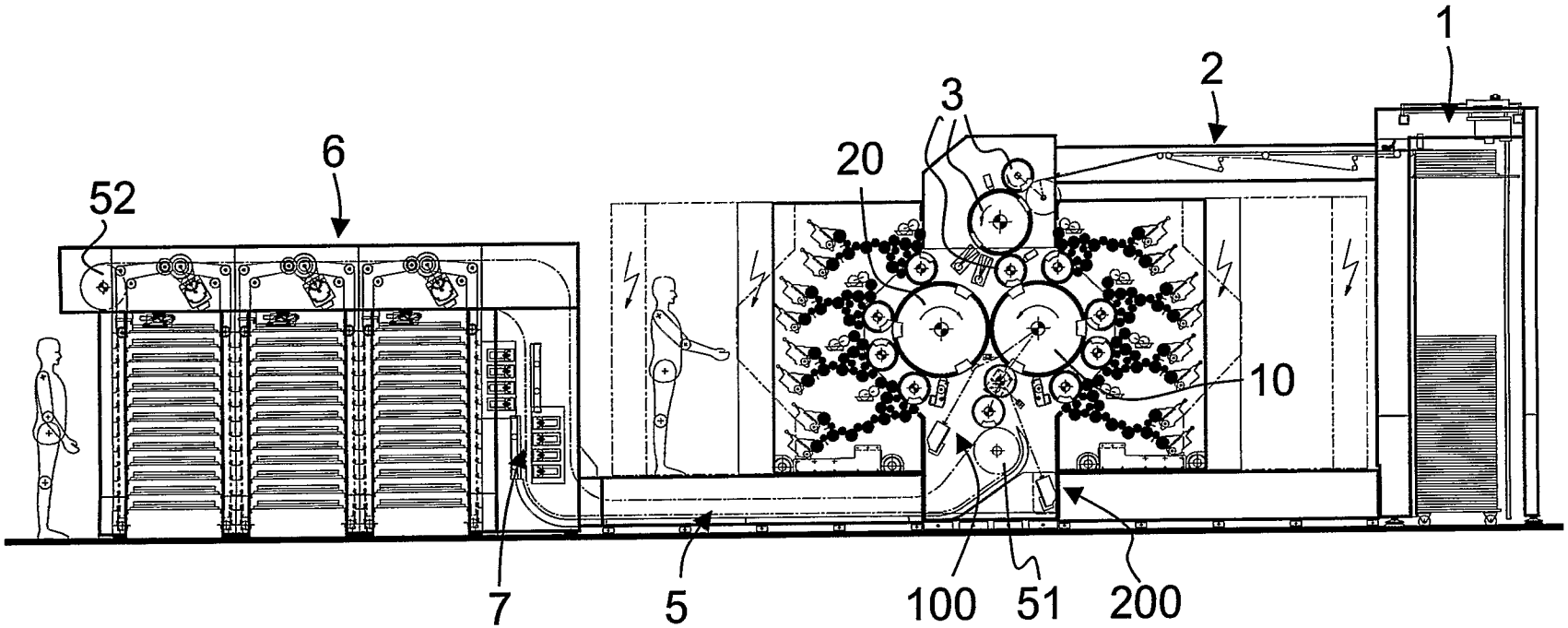
FIGS. 1A and 1B are side views of a sheet-fed recto-verso printing press for performing simultaneous recto-verso printing of sheets, which printing press is equipped with an in-line inspection system according to a first embodiment of the invention.

The invention will be described hereinafter in the context of a sheet-fed offset printing press for printing security papers, in particular banknotes. As this will be apparent from the following, the various embodiments illustrated in the drawings are based on a common machine configuration with the same printing group adapted for simultaneous recto-verso offset printing of the sheets. This printing group is as such similar to that described in European patent application EP 0 949 069 which is incorporated herein by reference. It will however be understood that the printing group could be adapted for performing printing according to other printing processes.

Figure 1B:
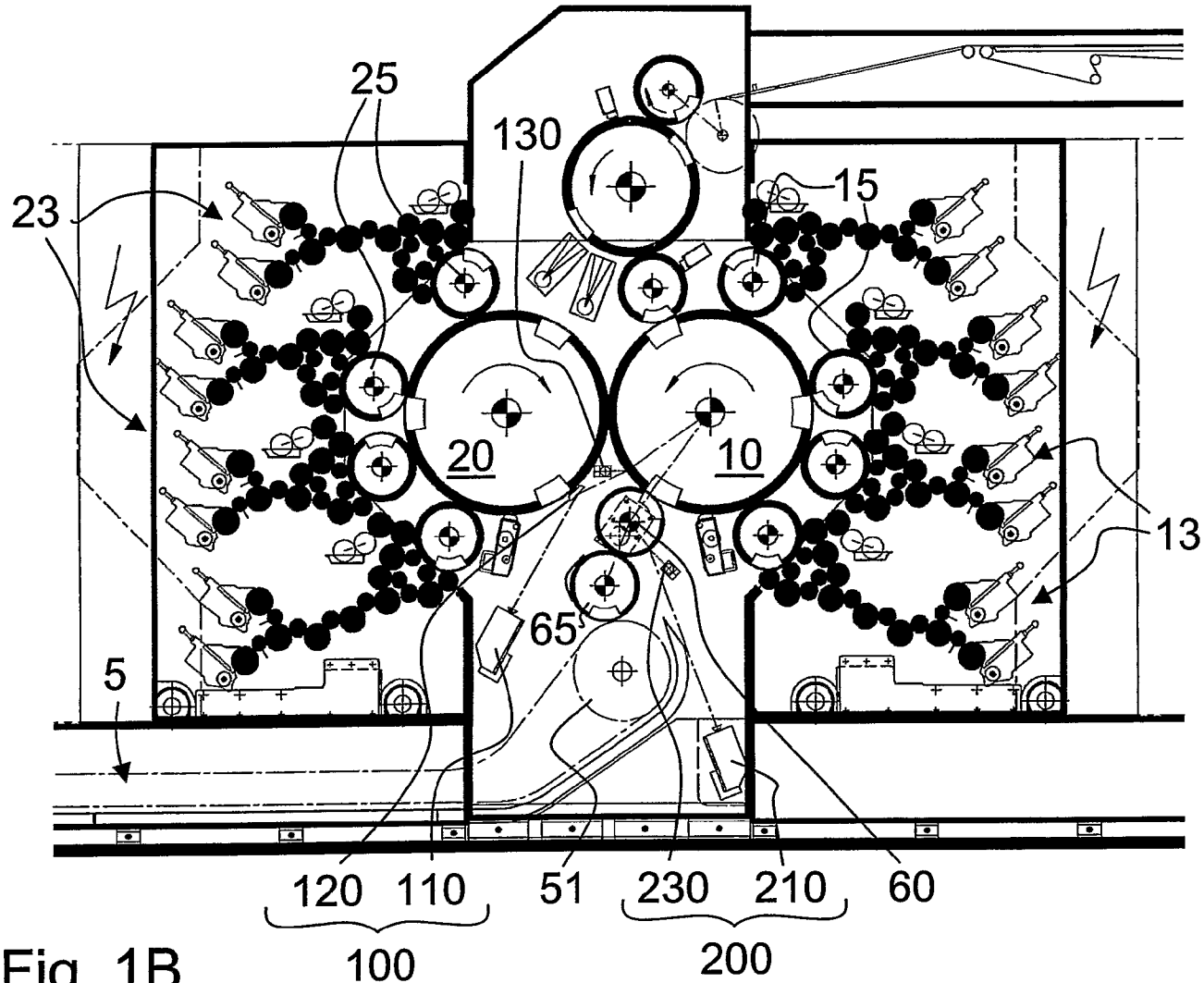

FIGS. 1A and 1B are side views of a sheet-fed offset printing press with an inspection system according to a first embodiment of the invention. The printing group of the press, which is adapted in this case to perform simultaneous recto-verso offset printing of the sheets, comprises in a conventional manner two blanket cylinders (or printing cylinders) 10, 20 rotating in the direction indicated by the arrows and between which the sheets are fed to receive multicolored impressions. In this example, blanket cylinders 10, 20 are three-segment cylinders, i.e. cylinder having a peripheral length approximately three times the length on the printed sheets. The blanket cylinders 10, 20 receive different inked patterns in their respective colors from plate cylinders 15 and 25 (four on each side) which are distributed around the circumference of the blanket cylinders 10, 20. These plate cylinders 15 and 25, which each carry a corresponding printing plate, are themselves inked by corresponding inking devices 13 and 23, respectively, in a manner known in the art. The two groups of inking devices 13 and 23 are advantageously placed in two inking carriages that can be moved toward or away from the centrally-located plate cylinders 15, 25 and blanket cylinders 10, 20.

Sheets are fed from a feeding station 1 located at the right-hand side of the printing group onto a feeding table 2 and then to a succession of transfer cylinders 3 (three cylinders in this example) placed upstream of the blanket cylinders 10, 20. While being transported by the transfer cylinders 3, the sheets may optionally receive a first impression on one side of the sheets using an additional printing group (not illustrated) as described in EP 0 949 069, one of the transfer cylinders 3 (namely the two-segment cylinder in FIG. 1A) fulfilling the additional function of impression cylinder. In case the sheets are printed by means of the optional additional printing group, these are first dried before being transferred to the blanket cylinders 10, 20 for simultaneous recto-verso printing. In the example of FIGS. 1A and 1B, the sheets are transferred onto the surface of the first blanket cylinder 10 where a leading edge of each sheet is held by appropriate gripper means disposed in cylinder pits between each segment of the blanket cylinder. Each sheet is thus transported by the first blanket cylinder 10 to the printing nip between the blanket cylinders 10 and 20 where simultaneous recto-verso printing occurs. Once printed on both sides, the printed sheets are then transferred as known in the art to a chain gripper system 5 for delivery in a sheet delivery station 6 comprising multiple delivery piles (three in this example).

The chain gripper system 5 typically comprises a pair of chains holding a plurality of spaced-apart gripper bars (not shown) each provided with a series of grippers for holding a leading edge of the sheets. In the example of FIG. 1A, the chain gripper system 5 extends from below the two blanket cylinders 10, 20, through a floor part of the printing press and on top of the three delivery piles of the delivery station 6. The gripper bars are driven along this path in a clockwise direction, the path of the chain gripper system 5 going from the printing group to the sheet delivery station 6 running below the return path of the chain gripper system 5. Drying means 7 are disposed along the path of the chain gripper system in order to dry both sides of the sheets, drying being performed using infrared lamps and/or UV lamps depending on the type of inks used. In this example, the drying means 7 are located at a vertical portion of the chain gripper system 5 where the gripper bars are led from the floor part of the printing press to the top of the sheet delivery station 6.

At the two extremities of the chain gripper system 5, namely below the blanket cylinders 10, 20 and at the outermost left-hand-side part of the sheet delivery station 6, there are provided pairs of chain wheels 51 and 52.

In the example of FIGS. 1A and 1B, first and second transfer cylinders 60, 65 are interposed between the pair of chain wheels 51 and the first blanket cylinder 10 so that printed sheets can be taken away from the surface of the first blanket cylinder 10 and then transferred in succession to the first transfer cylinder 60, to the second transfer cylinder 65 and finally to the chain gripper system 5.

Turning now to the inspection system, the printing press shown in FIGS. 1A and 1B is further provided with two inspection devices 100 and 200 for taking images of both sides of the printed sheets, one side of the sheets being inspected by means of inspection device 100, while the other side of the sheets is inspected by means of inspection device 200. As illustrated in greater detail in FIG. 1B, the inspection device 100 comprises a line image sensor 110 for performing line-scanning image acquisition of one side of the printed sheets. "Line-scanning image acquisition" shall be understood as an image acquisition process whereby a surface or object is scanned line after line and the complete image of the surface or object is reconstructed from the plurality of scanned line portions. It is to be understood that line-scanning image acquisition involves a relative displacement of the image sensor with respect of the surface or object to be imaged. In this example, the relative displacement is caused by the rotation of the blanket cylinder 10 transporting the sheet to inspect.

More precisely, the inspection device 100 is disposed in such a way that the first line image sensor 110 visually acquires an image of a printed sheet while the printed sheet is still adhering onto the surface of the first blanket cylinder 10 of the printing press and immediately before the printed sheet is transferred to the down-stream located transfer cylinder 60. In the embodiment of FIGS. 1A and 1B, the first inspection device 100 further comprises a mirror 120 for diverting the optical path of the line image sensor 110 onto the surface of the printing cylinder. This mirror 120 advantageously permits to locate and orient the first inspection device 100 in a very compact manner in the printing press. More precisely, since, in this embodiment, the transfer cylinders 60, 65 and the chain wheels 51 of the chain gripper system 5 take a substantial amount of the available space immediately below the blanket cylinders 10, 20, the mirror 120 permits to by-pass the transfer cylinders 60, 65 and the chain wheels 51 and get access to the portion of the circumference of the blanket cylinder 10 between the printing nip and the sheet transfer location where the sheets are taken away from the blanket cylinder.

Carrying out inspection at this location has shown to be advantageous as the freshly printed sheet is still adhering to the surface of the blanket cylinder 10. One thus exploits the inherent function of the blanket cylinder as a reference surface for carrying out inspection. In addition, the fresh ink has a sticking effect which prevent the sheets from detaching too easily from the surface of the blanket cylinder 10. No smearing problems can accordingly occur as the sheet is still in contact with the printing form. In addition, the distance between the printing nip and the sheet transfer location being less than the length of the sheet, inspection is carried out at a time where the sheet is still held between the blanket cylinders 10, 20 at the printing nip thereof and/or held by its leading edge by the transfer cylinder 60.

As shown in FIGS. 1A and 1B, the line image sensor 110 and mirror 120 are disposed below the second blanket cylinder 20 and are oriented in such a manner that a first portion of the optical path of the line image sensor 110 extending between the first line image sensor 110 and the mirror 120 is approximately tangential to the circumference of the second blanket cylinder 20 and that a second portion of the optical path of the line image sensor 110 extending between the mirror 120 and the surface of the first blanket cylinder 10 is approximately perpendicular to the circumference of the blanket cylinder 10. A light source 130 is further disposed immediately below the printing nip so as to illuminate the inspected zone on the sheet carried by the blanket cylinder 10.

The other inspection device 200 similarly comprises a line image sensor 210 for performing line-scanning image acquisition of the other side of the printed sheets while these are transported by the first transfer cylinder 60. No mirror is required in this example, as the first transfer cylinder 60 enables presenting the other side of the printed sheets directly in front of the line image sensor 210. A light source 230 is also disposed in order to appropriately illuminate the inspected zone on the sheet carried by the transfer cylinder 60.

The transfer cylinders 60 and 65 are preferably one-segment cylinders for carrying one sheet at a time and are preferably treated with or comprise an ink-repellent coating for preventing smearing of the printed sheets. Smearing problems are not as such critical as the printed sheets are directly transferred from the blanket cylinder 10 to the transfer cylinder 60, and from the transfer cylinder 60 to the other transfer cylinder 65. Smearing problems are exacerbated when the printed sheets are transferred from one type of transporting device to another type of transporting device, such as for instance from a chain gripper system to a cylinder as proposed in EP 1 142 712, EP 1 167 034 and EP 1 323 529, because of the inherent speed differences and speed inaccuracies between the two systems. Advantageously, the first and second transfer cylinder 60, 65 are designed as suction drums.

Figure 2:
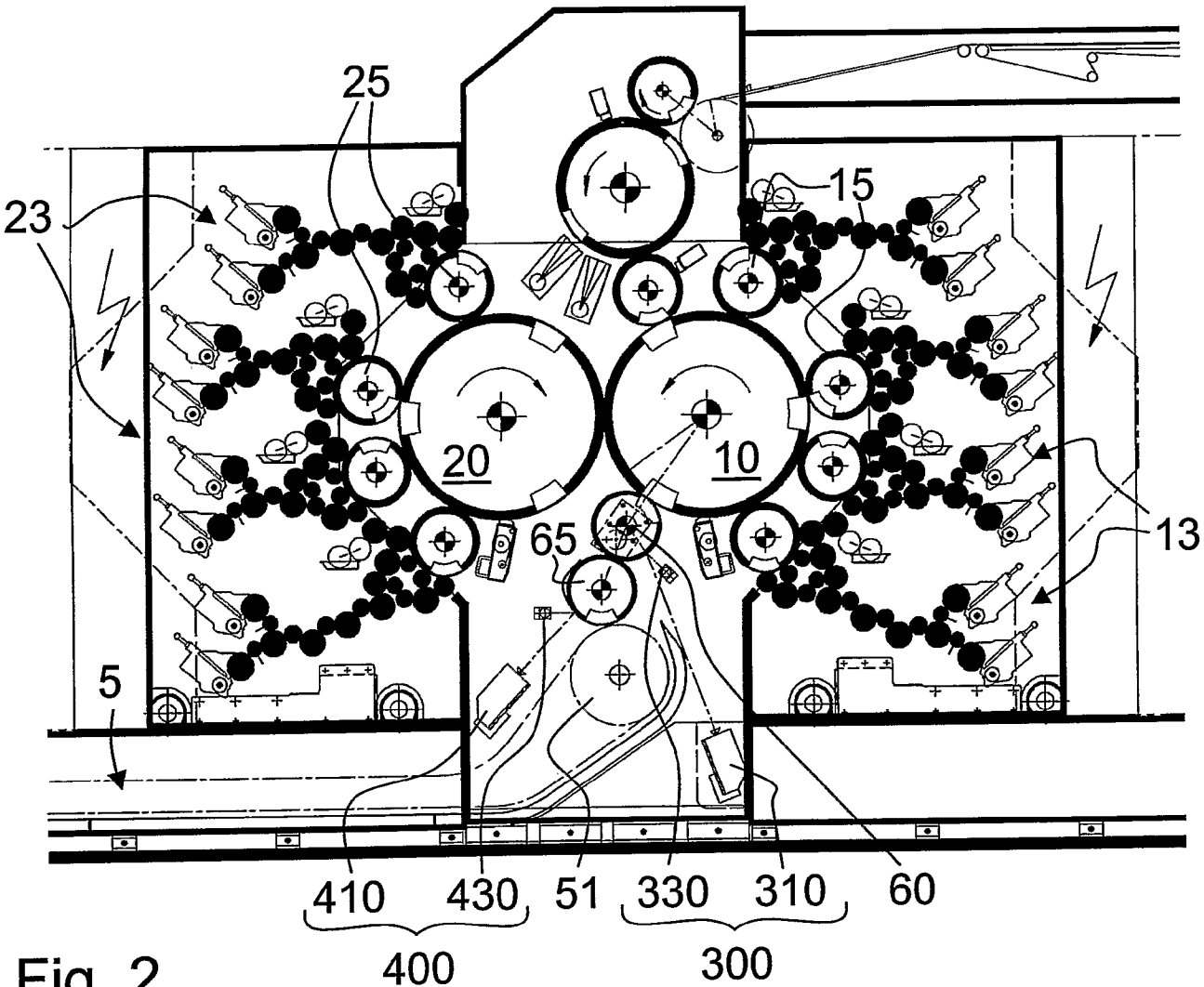
FIG. 2 is a side view of a sheet-fed recto-verso printing press similar to that of FIGS. 1A and 1B showing a second embodiment of the invention.

In the example of FIGS. 1A and 1B, one side of each printed sheet is inspected by inspection device 100 while the sheet is still carried by the blanket cylinder 10 and the other side of the printed sheet is inspected by inspection device 200 while the sheet is carried by the first transfer cylinder 60. As illustrated in FIG. 2, an alternative may consist in carrying out recto-verso inspection while the sheets are carried by the first and second transfer cylinders 60 and 65.

The embodiment illustrated in FIG. 2 is almost identical to that illustrated in FIGS. 1A and 1B, except that one side of each printed sheet is inspected by a first inspection device 300 while the sheet is carried by the first transfer cylinder 60 and that the other side of the printed sheet is inspected by a second inspection device 400 while the sheet is carried by the second transfer cylinder 65.

In this other embodiment, the arrangement and configuration of the first inspection device 300 is identical to that of inspection device 200 in FIGS. 1A and 1B and comprises a line image sensor 310 for performing line-scanning image acquisition of one side of the printed sheets while these are transported by the first transfer cylinder 60, as well as a light source 330 for illuminating the sheets. The second inspection device 400, on the other hand, is disposed in such a way that it visually acquires an image of the other side of each printed sheet while it is carried by the second transfer cylinder 65. To this end, the line image sensor 410 of the second inspection device 400 is oriented towards a part of the circumference of the second transfer cylinder 65, a light source 430 being similarly disposed so as to appropriately illuminate the inspected region.

It will be understood that various modifications and/or improvements obvious to the person skilled in the art can be made to the embodiments described hereinabove without departing from the scope of the invention defined by the annexed claims. For instance, while the embodiments show that the freshly printed sheets are carried by the first blanket cylinder 10, other solutions within the scope of the invention might provide for the transport of the printed sheets by means of the second blanket cylinder 20. Within the scope of the claims, it shall therefore be understood that the expression "first printing cylinder" and "second printing cylinder" can designate any of the two printing cylinders. In addition, while the invention has been described in connection with a printing press for performing simultaneous recto-verso offset printing, the machine might perform simultaneous printing according to other printing processes.

The invention claimed is:

1. A sheet inspection system for a sheet-fed recto-verso printing press of the type including two printing cylinders for carrying out simultaneous recto-verso printing of the sheets, the sheet inspection system comprising an inspection device for taking an image of one side of the printed sheets, wherein the sheet inspection system includes first and second transfer cylinders interposed between a first of the two printing cylinders and a chain gripper system of the printing press, printed sheets being transferred successively from the first printing cylinder to the first transfer cylinder, to the second transfer cylinder, and to the chain gripper system, the first transfer cylinder cooperating with the first printing cylinder to take away the printed sheets from the surface of the first printing cylinder and transfer the printed sheets to the second transfer cylinder, which printed sheets are then transferred from the second transfer cylinder to the chain gripper system, and wherein the inspection device include a line image sensor for performing line-scanning image acquisition of the one side of the printed sheets, the line image sensor visually acquiring an image of a printed sheet while the printed sheet is being transported on the first or second transfer cylinder.

2. The sheet inspection system according to claim 1, wherein the line image sensor visually acquires an image of a printed sheet while it is being transported on the first transfer cylinder and wherein the sheet inspection system further comprises another inspection device for taking an image of the other side of the printed sheets, the other inspection device comprising a second line image sensor for performing line-scanning image acquisition of the other side of the printed sheets, the second line image sensor visually acquiring an image of a printed sheet while the printed sheet is being transported on the second transfer cylinder.

3. The sheet inspection system according to claim 1, wherein the first and second transfer cylinders are one-segment cylinders for carrying one sheet at a time.

4. The sheet inspection system according to claim 1, wherein the surface of the first and second transfer cylinders is treated with an ink-repellent coating for preventing smearing of the printed sheets.

5. The sheet inspection system according to claim 1, wherein the first and second transfer cylinders are designed as suction drums.

6. A recto-verso printing press for carrying out simultaneous recto-verso printing of sheets comprising:

a printing group with first and second contacting printing cylinders for simultaneously printing both sides of sheets that are fed to a printing nip between the first and second printing cylinders;

a chain gripper system for transporting the sheets printed by the printing group to a sheet delivery station; and a sheet inspection system for carrying out in-line inspection of the printed sheets, the sheet inspection system comprising an inspection device for taking an image of one side of the printed sheets, wherein the sheet inspection system further includes first and second transfer cylinders interposed between the first printing cylinder and the chain gripper system of the printing press, printed sheets being transferred successively from the first printing cylinder to the first transfer cylinder, to the second transfer cylinder, and to the chain gripper system, the first transfer cylinder cooperating with the first printing cylinder to take away the printed sheets from the surface of the first printing cylinder and transfer the printed sheets to the second transfer cylinder, which printed sheets are then transferred from the second transfer cylinder to the chain gripper system, the inspection device including a line image sensor for performing line-scanning image acquisition of the one side of the printed sheets, the line image sensor visually acquiring an image of a printed sheet while the printed sheet is being transported on the first or second transfer cylinder.

7. The sheet inspection system according to claim 3, wherein the surface of the first and second transfer cylinders is treated with an ink-repellent coating for preventing smearing of the printed sheets.

8. The sheet inspection system according to claim 4, wherein the first and second transfer cylinders are designed as suction drums.

9. The sheet inspection system according to claim 1, wherein the first and second transfer cylinders are located immediately below the two printing cylinders.

10. The recto-verso printing press according to claim 6, wherein the line image sensor visually acquires an image of a printed sheet while it is being transported on the first transfer cylinder and wherein the sheet inspection system further comprises another inspection device for taking an image of the other side of the printed sheets, the other inspection device comprising a second line image sensor for performing line-scanning image acquisition of the other side of the printed sheets, the second line image sensor visually acquiring an image of a printed sheet while the printed sheet is being transported on the second transfer cylinder.

11. The recto-verso printing press according to claim 6, wherein the first and second transfer cylinders are one-segment cylinders for carrying one sheet at a time.

12. The recto-verso printing press according to claim 6, wherein the surface of the first and second transfer cylinders is treated with an ink-repellent coating for preventing smearing of the printed sheets.

13. The recto-verso printing press according to claim 6, wherein the first and second transfer cylinders are designed as suction drums.

14. The recto-verso printing press according to claim 6, wherein the first and second transfer cylinders are located immediately below the first and second printing cylinders.

* * * * *